United States Patent [19]

Payet

[11] 3,960,482

[45] June 1, 1976

[54] DURABLE PRESS PROCESS EMPLOYING HIGH MOISTURE CONTENT FABRICS

[75] Inventor: George Louis Payet, Cincinnati, Ohio

[73] Assignee: The Strike Corporation, Cincinnati, Ohio

[22] Filed: July 5, 1974

[21] Appl. No.: 486,168

[52] U.S. Cl. ..... 8/116.4; 8/115.6; 427/336; 427/439

[51] Int. Cl.[2] ..... B05D 3/04

[58] Field of Search ..... 8/116.4, 115.6

[56] References Cited

UNITED STATES PATENTS

| | | | |
|---|---|---|---|
| 2,311,080 | 2/1943 | Pinkney | 8/124 |
| 3,264,054 | 8/1966 | Reinhart et al. | 8/115.7 |
| 3,275,402 | 9/1966 | Daul et al. | 8/115.6 |
| 3,706,526 | 12/1972 | Swidler et al. | 8/115.7 |
| 3,837,799 | 9/1974 | Wilson et al. | 8/115.6 |

*Primary Examiner*—Carman J. Seccuro
*Attorney, Agent, or Firm*—Bacon & Thomas

[57] ABSTRACT

Cellulosic fiber-containing fabrics are made wrinkle resistant by a durable press process which comprises impregnating the fabric with an aqueous solution containing a water soluble acid, acid salt, or mixture thereof, capable of catalyzing the cross-linking reaction between formaldehyde and cellulose, and then exposing the impregnated fabric, while the fabric has a moisture content of above 20% by weight where the cellulose fibers are substantially completely swollen, to formaldehyde vapors and curing.

20 Claims, No Drawings

DURABLE PRESS PROCESS EMPLOYING HIGH MOSITURE CONTENT FABRICS

BACKGROUND OF THE INVENTION

1. Field of the Invention

This invention relates to a durable press process for cellulosic fiber-containing fabrics and more particularly to a process which utilizes formaldehyde and a non-gaseous catalyst to impart wrinkle resistance to cellulosic fiber-containing fabrics.

There have been a great many proposed processes in recent years for treating cellulosic fiber-containing products, such as cloth made of cotton or cotton blends, with formaldehyde to provide durable cross-linking of the cellulose molecules and to thereby impart durable crease resistance and smooth drying characteristics to the goods. However, problems have been encountered, and although a number of the processes have been operated commercially there is a great need for improvement.

As pointed out in U.S. Pat. No. 3,706,526, granted Dec. 19, 1972, the processes have tended to lack reproducibility, since control of the formaldehyde cross-linking reaction has been difficult. The process of this patent is said to solve the control problem by controlling moisture present in the cellulosic material during the reaction. The cellulosic material is conditioned to give it a moisture content of between about 4 to 20 percent, preferably 5 to 12 percent, based on the dry weight of the cellulose fiber, and it is then introduced into a gaseous atmosphere containing water vapor, a cellulose cross-linking amount of formaldehyde (e.g. 15 to 60 volume percent) and a catalytic amount of sulfur dioxide. However, the moisture control is difficult and the use of a toxic gas as the catalyst presents a safety factor as well as additional expense for environmental protection by requiring scrubbers and the like to eliminate the toxic substance from any effluent. Also, the presence of the gaseous catalyst and steam result in corrosion of the curing chamber.

Canadian Pat. No. 897,363, granted Apr. 11, 1972, discloses a process for the formaldehyde cure of cellulosic fibers which comprises applying to the cellolosic material, a solution of zinc chloride, ammonium chloride, phosphoric acid or zinc nitrate, conditioning the fabric to a moisture content of between about 7 and 15 based on the dry weight of the fabric, and thereafter exposing the catalyst-containing fabric or article made therefrom to an atmosphere of formaldehyde or formaldehyde vapor (5 to 75 percent volume percent) at a temperature between about 90° and 150°C.

The process requires precise moisture control and is said to be limited to the use of the few select catalysts.

Accordingly, a need exists for a simple and economical durable press process which does not depend on precise moisture control to moderate the cross-linking, does not require high concentrations of formaldehyde or utilize a noxious gaseous catalyst.

SUMMARY OF THE INVENTION

The present invention takes advantage of the observation that the cross-linking of cellulosic fibers with formaldehyde vapors takes place most readily when the fibers are in a moisture swollen condition. This is accomplished by introducing the fibers into a formaldehyde vapor treating chamber while they contain over 20 percent by weight of moisture, based on the dry weight of the fibers and, preferably, when over 60 percent by weight of moisture is present. Under these conditions the concentration of formaldehyde in the vapor treating chamber and amount of formaldehyde added can be kept to a minimum. Control of the reaction is accomplished by impregnating the cellulosic material with that amount of a selected non-gaseous catalyst which will produce the desired amount of cross-linking under the curing conditions used.

One object of this invention is to provide a durable press process which produces fabrics having high crease retention and excellent wash appearance with acceptable tensile strength.

Another object of this invention is to provide a process which is simple in operation and does not present corrosion problems inherent when acid gases such as sulfur dioxide are used as acid catalysts.

Another object of the invention is to provide a formaldehyde vapor treating process in which the formaldehyde concentration in the vapor treating chamber can be kept at a low value, thereby reducing explosion and fire hazards.

Yet another object is to provide a durable press treatment process which requires a relatively small amount of formaldehyde thereby significantly reducing the amount of excess formaldehyde found on the garment after treatment and thus substantially reducing the washing and steam cleaning required by the known processes.

Still another object of the invention is to provide a durable press process which enables the precise control of the catalysts present and avoids limitation upon use of water as the moderator of the reaction.

Another object is to avoid having formaldehyde gas present in the curing chamber in the presence of a gaseous catalyst and moisture which results in the formation of low level polymers of formaldehyde which form encrustation on the apparatus used to carry out the process.

A still further object of the invention, is to provide a durable press process which utilizes a novel mixed catalyst system.

A final object of the invention is to provide a continuous pre-cure press process for producing wrinkle-free fabrics.

DETAILED DESCRIPTION OF THE INVENTION

The process of the invention comprises impregnating a cellulosic fiber-containing fabric with an aqueous solution containing a selected amount of a water soluble acid, acid salt, or mixture thereof, which is capable of catalyzing the cross-linking reaction between formaldehyde and cellulose, then introducing said impregnated fabric, while the fabric has a moisture content of above 20 percent by weight and the fibers are substantially completely swollen, into formaldehyde vapors in a treating chamber and curing to improve the wrinkle resistance of the fabric. The fabric which has been impregnated with catalyst may be immediately treated with formaldehyde vapors, or may be dried and stored and/or fabricated into garments or other articles followed by re-moisturizing and treatment with formaldehyde vapors.

The invention does not use limited amounts of moisture to control the cross-linking reaction since the cross-linking reaction is most efficient in the most highly swollen state of the cellulose fiber. The relatively high amount of water present allows more efficient conversion of formaldehyde to the hydrate which is the cross-linker. Thus, optimum results can be obtained with much less formaldehyde.

During the cross-linking reaction at the curing stage, moisture is given up from the fabric as the cross-linking occurs, resulting in a decrease in the moisture content of the fabric. In fabrics having a moisture content of 20 percent or less, this tends to lower the effectiveness of the cross-linking reaction requiring higher concentrations of formaldehyde. In the process of the present invention, moisture is given up from a high level, that is, greater than 20 percent, preferably greater than 30 percent, e.g. from 60–100 percent or more, and the cross-linking is optimized. Moisture which is so difficult to control, is not a problem in the present invention which only requires that the moisture content be above 20 percent which is simple to insure. Of course, water is not allowed to be present in so much of an excess as to cause the catalyst to migrate on the fabric.

The necessary moisture may be applied to the fabric by any conventional technique. It may be added separately or in the form of an aqueous solution of the selected catalyst, as by padding, fogging, spraying or the like. A fog spray will achieve high moisture content in a very short time. In addition, water spray or fog insures uniform moisturization.

In the present process, the amount of catalyst used controls the cross-linking. Since the catalyst may be applied to the fabric by the textile mill by established methods that produce uniform application, precise control of the catalyst is insured. Preferably, an aqueous solution of the catalyst is padded onto the fabric so as to supply both the catalyst and the moisture in one operation. Of course, a spray technique could also be used. Since the catalyst is not gaseous, it is not subject to diffusion rates, air currents, garment moisture in the chamber or steam concentration within the chamber, and is easier to control and handle.

A wide range of acid catalysts may be used in the present process since the cross-linking is optimized by the high moisture content and fully swollen condition of the fibers. Such acid catalysts include acid salts, such as ammonium, magnesium, zinc, aluminum and alkaline earth metal chlorides, nitrates, bromides, bifluorides, sulfates, phosphates and fluoroborates. Magnesium chloride, aluminum and zirconium chlorohydroxide and mixtures thereof are particularly effective.

Water soluble acids which function as catalysts in the present process include sulfamic acid, phosphoric acid, adipic acid, fumaric acid and the like.

The catalysts may be used alone or as mixtures. A mixed catalyst of magnesium chloride and aluminum chlorohydroxide is a particularly preferred catalyst. Very uniform and reproducible results are obtained with this mixture.

The amount of catalyst may vary depending upon the particular type and the desired characteristic of the final fabric. However, in general the catalyst is incorporated in the fabric, on a dry weight basis, in an amount within the range of from 1.0 to about 10.0 percent, preferably about 1.0 to 6.0 percent.

The catalyst may be applied to the fabric from an aqueous solution by conventional techniques, preferably such as padding or spraying. The pH of the aqueous solution is generally in the range of about 3.9 to 4.6, although it may range to as high as about 6.8 for magnesium chloride. Padding is the preferred method of application since the amount of solution applied can be carefully controlled.

The catalyst may be added to the fabric at the textile mill followed by drying to provide a fabric containing only the catalyst. This fabric can be shipped and stored without danger of premature cross-linking since there is no formaldehyde present. The pre-catalyzed fabric can then be fabricated into a garment, pressed, remoisturized to over 20 percent and treated with formaldehyde. When the fabric is treated with the catalyst and then stored or fabricated into a garment before treatment with formaldehyde, it is preferable not to use the free acid liquid catalysts as they may leave an adverse effect upon containers and equipment, and in some instances have a tendency to degrade the fabric, especially during pressing. Solid catalysts are preferred in this instance.

Alternatively, the fabric may be continuously precured by first applying the aquesous catalyst solution to the fabric, adding moisture if necessary, and then exposing the fabric to formaldehyde vapors.

The concentration of the catalyst solution may be such as to supply with the catalyst that amount of water necessary to fully swell the cellulose fibers without further addition of moisture. Exposure to the formaldehyde vapors in this case is usually substantially immediately after the catalyst is applied to the fabric. Only two process steps are necessary, application of catalyst solution and treatment with formaldehyde vapors at the proper curing temperature. Of course, the fabric may be first formed into a garment and then impregnated with an aqueous solution of the acid catalyst followed by exposure to formaldehyde vapors. Again, the aqueous catalyst solution must contain sufficient water to fully swell the cellulose fibers or moisture must be added. The effect of moisture content of the fabric treated on the crease resistance of the washed product is shown by the following experiments:

EXPERIMENT I

The following samples of 80 × 80 cotton print cloth were padded with 3% magnesium chloride 3% aluminum chlorhydroxide (Chlorhydrol) in aqueous solution. The samples were padded to 100 percent pickup then air dried to the desired weight to give different moisture levels. The samples were then immediately placed in a reactor and exposed to formaldehyde vapors generated from paraformaldehyde over a 4 min. period. The temperature of the reactor was recorded at the start and end of the formaldehyde generating period. The temperatures of the reactor was then raised to 245°F. (Indicated reactor temperature).

| Sample No. | Formaldehyde Temp. Start °F. | End °F. | Moisture (%) | Crease Resistance W | F | W+F |
|---|---|---|---|---|---|---|
| 1 | 100 | 120 | 12.1 | 149.0 | 141.6 | 290.6 |
| 2 | 102 | 137 | 34.9 | 155.3 | 156.0 | 311.3 |
| 3 | 96 | 139 | 58.9 | 158.7 | 154.0 | 312.7 |
| 4 | 98 | 115 | 78.3 | 158.7 | 156.0 | 314.7 |
| 5 | 98 | 120 | 100.1 | 156.3 | 155.7 | 312.0 |

EXPERIMENT II

The following samples of 80 × 80 cotton print cloth were padded with a 2% aqueous solution of zinc nitrate then air dried to lower moisture contents until a desired weight was obtained. The samples were then quickly placed in a reactor. The reactor was sealed and the starting temperature noted. Paraformaldehyde (20g) was introduced to the vaporizing plate and the samples were exposed 4 min. to formaldehyde vapors at a maximum concentration of 6.0 percent. The final reactor temperature was recorded after the formaldehyde generating period and the heating system was turned on and the samples were heated to 245°F. (Indicated reactor temperature).

| Sample No. | Formaldehyde Temp. Start °F. | End °F. | Moisture (%) | Crease Resistance W | F | W+F |
|---|---|---|---|---|---|---|
| 1 | 100 | 110 | 10.4 | 133.0 | 135.0 | 268.0 |
| 2 | 95 | 120 | 25.0 | 157.3 | 146.7 | 304.0 |
| 3 | 95 | 120 | 56.8 | 153.3 | 155.0 | 308.3 |
| 4 | 100 | 133 | 75.0 | 157.7 | 150.3 | 308.0 |
| 5 | 100 | 135 | 92.4 | 155.3 | 153.0 | 308.3 |

As indicated, the high moisture content in the fabric fully swells the cellulose fibers and optimizes the cross-linking reaction thereby providing improved crease resistance. Accordingly, considerably less formaldehyde is required than in the known vapor processes. This results in a direct reduction in the cost of the process. Moreover, due to the lower concentration of formaldehyde required, less excess formaldehyde is found on the fabric after treatment and the extent to which washing or steam cleaning is required is minimized.

The formaldehyde concentration in the treatment chamber is from about 1.0 to about 6.5 percent by volume, preferably about 1.0 to 3.0 percent. The dry add-on by reaction of the formaldehyde with the fabric at this concentration is generally less than about 0.5 percent. At concentrations of formaldehyde below about 1 percent by volume in the treatment chamber the wash appearance and crease resistance become less satisfactory than desired. At concentrations of above about 3 percent there is usually no significant increase in these properties. This can be seen from Experiment III which shows the crease resistance and wash appearance as a function of the formaldehyde concentration in the treating chamber.

EXPERIMENT III

CREASE RESISTANCE AS A FUNCTION OF FORMALDEHYDE

| Sample No. | Formaldehyde % by Volume | Crease Resistance W | F | W+F | Wash Appearance |
|---|---|---|---|---|---|
| 1 | 6.12 | 158 | 156 | 314 | 5 |
| 2 | 4.59 | 158 | 154 | 312 | 5 |
| 3 | 3.06 | 158 | 154 | 312 | 5 |
| 4 | 1.53 | 159 | 155 | 314 | 5 |
| (Control) | No Treatment | 90 | 92 | 182 | 1 |
| The following samples contain 2% Viva, a conventional fabric softener: | | | | | |
| 5 | 1.23 | 152 | 149 | 301 | 4–5 |
| 6 | 0.92 | 141 | 140 | 281 | 4 |
| 7 | 0.61 | 130 | 121 | 251 | 3 |
| 8 | 0.31 | 126 | 123 | 249 | 2 |

The samples for Experiment III were 80 × 80 cotton print containing 2 percent of aluminum chlorohydroxide (on a dry weight basis) as a catalyst, applied by padding a 2 percent aqueous solution of the catalyst on the samples to provide 100 percent pick-up, and were immediately treated without drying with formaldehyde and cured at a temperature of about 260°F.

The utilization of small concentrations of formaldehyde in the treating chamber significantly reduces the fire hazard presented by formaldehyde since formaldehyde tends to be explosive in concentrations of 7 percent by volume or above when mixed with air.

The curing temperature at which the final cross-linking takes place is in the range of from about 230° F. to 325° F, preferably about 240° F. to 275° F. Advantageously, it should be at least about 245° F. to insure that there is sufficient cross-linking to provide the necessary wrinkle reistance in the fabric. Temperatures above 325° F., as conventionally employed in resin curing, do not improve the present process and may serve to degrade the fabric by the action of the catalyst. The formaldehyde treatment and curing may take place in the same treating chamber or in separate chambers or zones of the treating apparatus.

It is sometimes desirable, depending upon the desired characteristic of the fabric, to add to the fabric a polymeric resinous additive that is capable of forming soft film. For example, such additives may be a latex or fine aqueous dispersion or polyethylene, various alkyl acrylate polymers, acrylonitrile-butadiene copolymers, deacetylated ethylene-vinyl acetate copolymers, polyurethanes and the like.

Such additives are well known to the art and generally commercially available in concentrated aqueous latex form. For use in the process of this invention, such a latex is diluted to provide about 1 to 3 percent polymer solids in the aqueous catalyst-containing padding bath before the fabric is treated therewith. However, it is not necessary or desirable to add monomers or formaldehyde binding agents.

As the cellulosic fiber-containing fabric which may be treated by the present process there can be employed various natural or artificial cellulosic fibers and mixtures thereof, such as cotton, linen, hemp, jute, ramie, sisal, rayons, e.g., regenerated cellulose (both viscose and cuprammonium). Other fibers which may be used in blends with one or more of the above-mentioned cellulosic fibers are, for example, polyamides (e.g., nylons), polyesters, acrylics (e.g. polyacrylonitrile), polyolefins, polyvinyl chloride, and polyvinylidene chloride. Such blends preferably include at least 35 to 40 percent by weight, and most preferably at least 50 to 60 percent by weight, of cotton or natural cellulose fibers.

The fabric may be a resinated material but preferably it is unresinated; it may be knit, woven, non-woven, or otherwise constructed. It may be flat, creased, pleated, hemmed, or shaped prior to contact with the formaldehyde containing stmosphere. After processing, the formed crease-proof fabric will maintain the desired configuration substantially for the life of the article. In addition, the article will have an excellent wash appearance even after repeated washings.

The equipment necessary to carry out the process is very mush simplified since moisture control is not used as the moderator for the reaction. The aqueous, acid catalyst may be applied by padding or spraying. Moisturization of the fabric, if additional moisture is necessary, may be carried out by passing the fabric through a fog of water before entering the reaction chanber. The fabric containing the latent catalyst may then be placed in a reaction chamber to which gaseous formaldehyde is supplied from any convenient source, e.g., a formaldehyde generator wherein formaldehyde vapor is produced by heating para-formaldehyde. The formaldehyde vapors are diluted with air or other gas to provide the desired concentration. Preferably, the formaldehyde is generated outside the chamber containing the fabric to reduce the fire hazard.

The reaction chamber is preferably one which can be heated to a sufficiently high temperature to insure that the cross-linking reaction takes place. The atmosphere in the reaction chamber is preferably a mixture containing from 1 to 6.5 percent formaldehyde gas by volume, diluted with air or an inert gas such as nitrogen. Higher concentrations of formaldehyde could be used but are not required by this process.

To contact the fabric with formaldehyde vapors any suitable means may be employed. For example, a batch system utilizing a closed vessel or tube containing the gaseous formaldehyde or into which formaldehyde is introduced may be used. The catalyst-containing fabric may be placed in the treating vessel for the appropriate time. In the alternative, a dynamic or continuous system can be used such as one wherein a stream of formaldehyde vapor is passed through a closed elongated chamber through which the fabric is also passed at an appropriate rate, either concurrently or countercurrently relative to the formaldehyde vapor or gas mix. It is also possible to use combinations of the above, such as by passing a stream of formaldehyde containing gas over a stationary fabric.

Having generally described this invention, a further understanding can be obtained by reference to certain specific examples which are provided herein for purposes of illustration only and are not intended to be limiting unless otherwise specified.

EXAMPLE I

Samples of an 80 × 80 cotton print cloth were padded with an aqueous solution of catalyst as indicated in the following Table I to provide about 100 percent pick-up. The amount of catalyst shown in Table I is solution concentration, which at 100 percent pick-up of solution by the fabric also corresponds to the amount of catalyst by weight incorporated into the fabric based on the dry weight of the fabric. The cellulose fibers of the cloth at the 100 percent pick-up of solution were swollen to their maximum extent. The samples, without drying, were then placed in a heating chamber into which vapors from an amount of paraformaldehyde calculated to provide the designated maximum volume percent of formaldehyde were introduced. The samples were exposed to the formaldehyde vapors for several minutes at about 100°F and were then heated to about 260°F in the chamber atmosphere.

The samples were then removed from the chamber and washed. The crease resistance (Wrinkle Recovery) was determined by A.A.T.C.C. Test Method 66—1968 and the wash appearance (D.P. Wash) was determined in accordance with A.A.T.C.C. Test Method 124—1969 in which a rating of 5 is most satisfactory. The results are set forth in Table I.

TABLE I

| Sample No. | Catalyst | ** Amt. % | *** Formaldehyde | Crease Resistance W | F | W+F | D.P. Wash | Color |
|---|---|---|---|---|---|---|---|---|
| 9 | $Al(OH)_5Cl$* | 2.0 | 3.06% | 152 | 156 | 308 | 5 | Off White |
| 10 | $Al(OH)_5Cl$ | 2.0 | 3.06% | 158 | 156 | 314 | 5 | Off White |
| 11 | $Al(OH)_5Cl$ | 2.0 | 3.06% | 153 | 160 | 313 | 5 | Off White |
| 12 | $Al(OH)_5Cl$ | 2.0 | 1.53% | 153 | 152 | 305 | 4–5 | Off White |
| 13 | $Al(OH)_5Cl$ | 2.0 | 1.53% | 153 | 156 | 309 | 4–5 | Off White |
| 14 | $Al(OH)_5Cl$ | 2.0 | 1.53% | 159 | 153 | 312 | 4–5 | Off White |
| 15 | Oxalic Ac. | 2.0 | 3.06% | 150 | 145 | 295 | 4–5 | White |
| 16 | Oxalic Ac. | 2.0 | 3.06% | 156 | 150 | 306 | 4–5 | White |
| 17 | Citric Ac. | 2.5 | 3.06% | 142 | 145 | 287 | 4–5 | White |
| 18 | Citric Ac. | 2.5 | 1.53% | 148 | 146 | 294 | 4–5 | White |
| Untreated | ——— | | ——— | 90 | 92 | 182 | 1 | White |

* Aluminum chlorhydroxide (commercially available as 50% solution in water).
** Solution concentration % — same as dry weight on fabric at 100% solution pick-up.
***Maximum Volume % in treatment chamber.
These explanations apply to all subsequent tables.

As can be seen from the table, excellent crease resistance and wash appearance were obtained. A crease resistance of 290 and a wash appearance of 3 is considered good by current standards in the industry.

EXAMPLE 2

The process of Example 1 was again carried out with aluminum chlorohydrate, magnesium chloride, and citric catalysts. In addition, a commercial softener manufactured by Proctor and Gamble under the trade name VIVA was used as a fabric softener. Some of the samples contained 2% Acrysol ASE 95 (acrylic emulsion) which is a known additive used as a hand builder. The crease resistance and wash appearance were measured as in Example 1. The Filling Tensile strength was also determined by standard test. The results are shown in Table II, below.

EXAMPLE 3

The process of Example 1 was again followed using a variety of different catalysts. The crease resistance and wash appearance were determined. The results are shown in Table III, below.

TABLE II

| Sample No. | Catalyst Type | Amt.% | Formaldehyde Amt. Vol. % | Softeners Type | Amt. % | Crease Resistance W | F | W+F | D.P. Wash | Filling Tensile Strength lbs. |
|---|---|---|---|---|---|---|---|---|---|---|
| 19 | $Al(OH)_5Cl$ | 2.0 | 4.59% | Viva | 2.0 | 164 | 160 | 324 | 5 | 7.9 |
| 20 | $Al(OH)_5Cl$ | 2.0 | 4.59% | Viva | 2.0 | 160 | 162 | 322 | 5 | — |
| 21 | $Al(OH)_5Cl$ | 2.0 | 4.59% | Viva | 2.0 | 161 | 165 | 326 | 5 | — |
| 22 | $Al(OH)_5Cl$ | 1.0 | 4.59% | Viva | 2.0 | 154 | 161 | 318 | 5 | 10.3 |
| 23 | $Al(OH)_5Cl$ | 1.0 | 4.59% | Viva | 2.0 | 163 | 160 | 323 | 5 | — |
| 24 | $Al(OH)_5Cl$ | 1.0 | 4.59% | Viva | 2.0 | 159 | 160 | 319 | 5 | — |
| 25 | Citric Ac. | 2.0 | 4.59% | Viva | 2.0 | 159 | 157 | 316 | 4–5 | 10.8 |
| 26 | Citric Ac. | 2.0 | 4.59% | Viva | 2.0 | 157 | 153 | 310 | 4–5 | 10.8 |

TABLE II-continued

| Sample No. | Catalyst Type | Amt.% | Formaldehyde Amt. Vol. % | Softeners Type | Amt. % | Crease Resistance W | F | W+F | D.P. Wash | Filling Tensile Strength lbs. |
|---|---|---|---|---|---|---|---|---|---|---|
| 27 | $MgCl_2$ | 2.0 | 4.59% | Viva | 2.0 | 158 | 152 | 310 | 4–5 | 12.2 |
| 28 | $MgCl_2$ | 2.0 | 4.59% | Viva | 2.0 | 151 | 155 | 306 | 4–5 | 10.0 |
| These samples contained 2% Acrysol ASE 95. | | | | | | | | | | |
| 29 | $Al(OH)_5Cl$ | 2.0 | 3.06% | Viva | 2.0 | 156 | 154 | 310 | 4–5 | — |
| 30 | $Al(OH)_5Cl$ | 2.0 | 3.06% | Viva | 2.0 | 156 | 158 | 314 | 5 | — |
| Polyester Cotton Shirting Fabric 65/35 7406 | | | | | | | | | | |
| 31 | $Al(OH)_5Cl$ | 2.0 | 3.06% | Viva | 2.0 | 159 | 149 | 308 | 4–5 | 40.8 |
| 32 | D.P. Finish | — | — | — | — | 147 | 156 | 303 | 4–5 | 41.7 |
| 33 | Control-No Finish | | — | — | — | 143 | 150 | 293 | 3–4 | 43.4 |

TABLE III

| Sample No. | Catalyst | Amt. % | W | F | W+F | D.P. Wash | Color |
|---|---|---|---|---|---|---|---|
| 34 | Magnesium Fluoborate | 2.0 | 157 | 151 | 308 | 5 | White |
| 35 | Zinc Fluoborate | 2.0 | 153 | 151 | 304 | 5 | White |
| 36 | Citric Acid | 2.0 | 147 | 143 | 290 | 4 | White |
| 37 | Zinc Nitrate | 2.0 | 151 | 150 | 301 | 4 | Very Yellow |
| 38 | Magnesium Chloride | 2.0 | 147 | 150 | 297 | 5 | White |
| 39 | Phosphoric Acid | 2.0 | 153 | 153 | 306 | 5 | Yellow |
| 40 | Fumaric Acid | 2.0 | 114 | 138 | 252 | 3–4 | White |
| 41 | Oxalic Acid | 2.0 | 153 | 159 | 312 | 4–5 | White |
| 42 | Adipic Acid | 2.0 | 134 | 118 | 252 | 3 | White |
| 43 | Ammonium Chloride | 2.0 | 150 | 152 | 302 | 5 | Yellow |
| 44 | Aluminum Chlorhydroxide | 2.0 | 152 | 156 | 308 | 5 | Off White |
| 45 | Untreated Cotton 80×80 Print Cloth | | 90 | 92 | 182 | 1 | White |

As can be seen from Table III, the various catalysts gave excellent results. However, zinc nitrate, phosphoric acid and ammonium chloride yellowed the fabric and would preferably not be used where white fabrics are desired

EXAMPLE 4

The strength retention on a 100 percent cotton fabric (original strength 32.8) was determined using $MgCl_2$ as the catalyst in the process of Example 1. The results are as shown in Table IV.

TABLE IV

Strength Retention on 100% Cotton

| Sample No. | Cat. | Amt. | Strength | % Retained |
|---|---|---|---|---|
| 46 | $MgCl_2$ | 2.0 | 13.8 | 42.1 |
| 47 | $MgCl_2$ | 2.0 | 14.8 | 45.1 |

A strength retention of 42.1 and 45.1 excellent.

EXAMPLE 5

To determine the effectiveness of mixed catalyst system the process of Example 1 was followed using $MgCl_2$ and $Al(OH)_5$ Cl separately and a mixture of $MgCl_2$ and $Al(OH)_5$ Cl as the catalyst. The results are as follows in Table V.

TABLE V

| Sample No. | Fabric Type | Cat. Type | Amt. in Mix % | Cat. Total Amt. % | Formaldehyde Vol. % | $CH_2O$* Time | Moisture % | D.P. Wash |
|---|---|---|---|---|---|---|---|---|
| 48 | 65/35P.C. | $MgCl_2$ | 3 | 5 | | | | |
| | | $Al(OH)_5Cl$ | 2 | | 6.12 | 4 | 100 | 4–5 |
| 49 | 65/35P.C. | $MgCl_2$ | — | 5 | 6.12 | 4 | 100 | 3–4 |
| 50 | 65/35P.C. | $MgCl_2$ | — | 6 | 6.12 | 4 | 100 | 3 |
| 51 | 65/35P.C. | $MgCl_2$ | 3 | 6 | | | | |
| | | $Al(OH)_5Cl$ | 3 | | 6.12 | 4 | 40–50 | 4–5 |
| 52 | 65/35P.C. | $MgCl_2$ | 5 | | | | | |
| | | $Al(OH)_5Cl$ | 3 | | 6.12 | 4 | 100 | 4 |
| 53 | 65/35P.C. | $MgCl_2$ | 3 | 6 | | | | |
| | | $Al(OH)_5Cl$ | 3 | | 6.12 | 4 | 100 | 4–5 |
| 54 | 65/35P.C. | $MgCl_2$ | 3 | 6 | | | | |
| | | $Al(OH)_5Cl$ | 3 | | 6.12 | 4 | 100 | 4–5 |
| 55 | 100% Cotton | $MgCl_2$ | 3 | 6 | | | | |
| | | $Al(OH)_5Cl$ | 3 | | 6.12 | 4 | 100 | 5 |
| 56 | 65/35P.C. | $MgCl_2$ | 3 | 5 | | | | |
| | | $MgHPO_4$ | 2 | | 6.12 | 4 | 100 | 4 |
| Control | 75/25P.C. | (No Treatment) | | | — | — | — | 2–3 |

*Exposure to formaldehyde vapors at 100°F before heating to 260°F.

As can be seen from these results, the combination of $MgCl_2$ and $Al(OH)_5$ provided a wash appearance between 4 and 5 whereas $MgCl_2$ alone on samples of the same material provided a wash appearance rating of 3 or at best between 3 and 4. The combination of these salts is considered a very desirable catalyst from the standpoint of both wash appearance and reproducibility of results. Formaldehyde vapor concentrations of about 6% by volume were in these tests.

EXAMPLE 6

The abrasion resistance of a 65/35 Polyester/cotton blend was determined. The polyester blend was treated by the procedure of Example 1 using 2.0% $MgCl_2$ as the catalyst and softener as indicated. The following results were obtained as shown in Table VI.

TABLE VI

| 65/35 Polyester/Cotton Sample No. | Cat. | Am.% | Softener Viva | Crease Resistance W | F | W+F | Abrasion %Lost | %Ret. |
|---|---|---|---|---|---|---|---|---|
| 57 | $MgCl_2$ | 2.0 | 2.0 | 158.7 | 156.3 | 315 | 6.79 | 93.21 |
| 58 | $MgCl_2$ | 2.0 | 2.0 | 157 | 157.3 | 314.3 | 6.23 | 93.77 |
| 59 | $MgCl_2$ | 1.0 | 2.0 | 156 | 161 | 317 | 4.86 | 95.14 |
| 60 | $MgCl_2$ | 1.0 | 2.0 | 157.7 | 160.7 | 318.4 | 5.51 | 94.49 |

Note: Abrasion run 2 Min. 2500 RPM

EXAMPLE 7

The effects of varying the amount of catalyst while maintaining the same concentrations of formaldehyde and of varying the concentration of formaldehyde while maintaining the same amount of catalyst were determined using the treating procedure of Example 1. The results are as follows in Table VII.

TABLE VIII

| Sample No. | Cat. | Amt. | Viva | Formaldehyde % by Vol. | Crease Resistance W | F | W+F | D.P. Wash Appear. | Color | Filling Tensile Strength | % Ret. |
|---|---|---|---|---|---|---|---|---|---|---|---|
| 61 | $MgCl_2$ | 2.0 | 2.0 | 3.06% | 160 | 159 | 319 | 4–5 | White | 10.6 | 32.2 |
| 62 | $MgCl_2$ | 1.0 | 2.0 | 3.06% | 159 | 154 | 313 | 4–5 | White | 12.3 | 38.5 |
| | | | | Style 9503 50/50 Polyester Cotton | | | | | | | |
| 63 | $MgCl_2$ | 2.0 | 2.0 | 3.06% | 159 | 165 | 324 | 4–5 | White | — | — |
| 64 | $MgCl_2$ | 2.0 | 2.0 | 1.53% | 159 | 164 | 323 | 4–5 | White | — | — |

As can be seen there is no significant difference when a lower concentration of catalyst is used or when a lower concentration of formaldehyde is used.

EXAMPLE 8

The effect of catalysts concentration on the tensile strength was determined for $MgCl_2$. The same procedure for treating the fabric as in Example 1 was followed. The results are shown in Table VIII.

TABLE VIII

| Sample No. | Catalyst | Amt. % $MgCl_2$ | Decreasing Concentrations of $MgCl_2$ Viva % | Crease Resistance W | F | W+F | D. P. Wash | Tensile Strength Filling (lbs.) |
|---|---|---|---|---|---|---|---|---|
| 65 | $MgCl_2$ | 2.0 | 2.0 | 159.7 | 159.7 | 319.4 | 4–5 | 9.0 |
| 66 | $MgCl_2$ | 1.0 | 2.0 | 156.7 | 157.0 | 313.7 | 4–5 | 11.1 |
| 67 | $MgCl_2$ | 0.75 | 2.0 | 155.3 | 154.7 | 310.0 | 4–5 | 13.4 |
| 68 | $MgCl_2$ | 0.50 | 2.0 | 154.0 | 151.0 | 305.0 | 4–5 | 13.4 |

It can be seen from the table that as the amount of catalyst used decreases the tensile strength increases and the crease resistance decreases. However, the crease resistance was satisfactory over the entire range of catalyst concentration.

All results reported in the foregoing specification were obtained by the following standard methods:

1. D.P. Wash — A.A.T.C.C. Test Method 124—1969.
2. Abrasion — Accelerotor Method A.A.T.C.C. Test Method 93—1970 Wt. Loss.
3. Crease Resistance (Wrinkle Recovery) — Recovery Method A.A.T.C.C. Test Method 66—1968.
4. Tensile Strength — A.S.T.M. D-1682-64 (Test IC)

Having now fully described the invention, it will be apparent to one of ordinary skill in the art that many changes and modifications can be made thereto without departing from the spirit or scope of the invention as set forth herein.

I claim:

1. A durable-press process for cellulosic fiber-containing fabrics, comprising, impregnating a cellulosic fiber-containing fabric with an aqueous solution containing a water soluble normally solid catalyst selected from the group consisting of acids, acid salts and mixtures thereof which are capable of catalyzing the cross-linking reaction between formaldehyde and cellulose, to provide from 0.1 to about 10.0 percent of said catalyst in said fabric on a dry weight basis, then exposing said impregnated fabric, while said fabric has a moisture content of about 20 percent by weight where the cellulose fibers are substantially completely swollen, to formaldehyde vapors and curing under conditions at which formaldehyde reacts with cellulose in the presence of the catalyst to improve the wrinkle resistance of the fabric.

2. The process of claim 1, wherein the catalyst is an acid salt selected from the group consisting of ammonium, magnesium, zinc, aluminum and alkaline earth metal chlorides, bromides, bifluorides, nitrates, sulfates, fluorates, phosphates and fluoroborates, and aluminum and zirconium chlorhydroxides.

3. The process of claim 1, wherein the catalyst is a water soluble acid selected from the group consisting of sulfamic acid, citric acid, oxalic acid, phosphoric acid, adipic acid and furmaric acid.

4. The process of claim 1, wherein the catalyst is a mixture of magnesium chloride and aluminum chlorhydroxide.

5. The process of claim 1, wherein the moisture content of the fabric at the time of exposure to formaldehyde is above about 30 percent by weight.

6. The process of claim 1, wherein the fabric is cotton.

7. The process of claim 1, wherein the fabric is a cotton-polyester blend.

8. The process of claim 1, wherein the temperature during the cross-linking reaction is in the range of about 240°F. to 270°F..

9. The process of claim 1, wherein the catalyst is $MgCl_2$.

10. The process of claim 1, wherein the catalyst is aluminum chlorhydroxide.

11. The process of claim 1, wherein the impregnated fabric is dried and then remoistened to a moisture content of about 20 percent by weight before being exposed to the formaldehyde vapors.

12. The process of claim 1, wherein the impregnated fabric is dried and formed into a garment and then remoistened to a moisture content of above 20 percent by weight.

13. The process of claim 1, wherein the fabric is exposed to an atmosphere containing no more than about 6.5 percent formaldehyde.

14. The process of claim 1, wherein the fabric is exposed to and atmosphere containing from about 1.0 to 3.0 percent by volume of formaldehyde.

15. The process of claim 1, wherein the fabric is a resinated material.

16. The process of claim 1, wherein the fabric is substantially immediately exposed to the formaldehyde vapors after being impregnated with the aqueous catalyst solution.

17. A durable-press process for cellulosic fiber-containing fabrics, comprising: impregnating a cellulosic fiber-containing fabric with an aqueous solution containing a water soluble, normally solid acid or acid salt catalyst capable of catalyzing the cross-linking reaction between formaldehyde and cellulose to provide from about 1.0 to 6.5 percent by weight of said catalyst and at least about 60 percent by weight of water in said fabric, based on the dry weight of the fabric, then exposing said fabric while containing said amount of water to formaldehyde vapors and curing at a temperature in the range of about 240°F. to 275°F. to cause cross-linking between the cellulose and formaldehyde while the fibers are in a swollen state to thereby improve the wrinkle resistance of the fabric.

18. The process of claim 17, wherein the fabric is continuously conveyed through solution applying and formaldehyde curing zones.

19. The process of claim 4, wherein the fabric is exposed to an atmosphere containing about 6.0 percent by volume of formaldehyde.

20. The process of claim 19, wherein the fabric contains from about 5.0 to about 6.0 percent by weight of said catalyst.

* * * * *